US007810972B2

(12) United States Patent
Popelek

(10) Patent No.: US 7,810,972 B2
(45) Date of Patent: Oct. 12, 2010

(54) HEADLAMP ASSEMBLY HAVING AN ADJUSTABLE LIGHT BEAM DIRECTION

(75) Inventor: Jan Popelek, Ostrava-Pustkovec (CZ)

(73) Assignee: Visteon Global Technologies, Inc., Van Buren Township, MI (US)

( * ) Notice: Subject to any disclaimer, the term of this patent is extended or adjusted under 35 U.S.C. 154(b) by 293 days.

(21) Appl. No.: 11/581,050

(22) Filed: Oct. 13, 2006

(65) Prior Publication Data

US 2008/0089085 A1 Apr. 17, 2008

(51) Int. Cl.
*F21V 14/00* (2006.01)

(52) U.S. Cl. ..... 362/514; 362/515; 362/512; 362/523; 362/530

(58) Field of Classification Search ..... 362/514, 362/515, 530, 531, 532, 39, 508, 529, 523
See application file for complete search history.

(56) References Cited

U.S. PATENT DOCUMENTS

| | | | | |
|---|---|---|---|---|
| 2,666,193 | A | 1/1954 | Keegan | |
| 4,345,303 | A | 8/1982 | Gerard et al. | |
| 4,369,488 | A | 1/1983 | Brun | |
| 4,768,135 | A | 8/1988 | Kretschmer et al. | |
| 4,811,174 | A | 3/1989 | Kanzler et al. | |
| 4,875,141 | A | 10/1989 | Miyauchi et al. | |
| 5,060,120 | A | 10/1991 | Kobayashi et al. | |
| 5,068,768 | A | 11/1991 | Kobayashi | |
| 5,138,540 | A | 8/1992 | Kobayashi et al. | |
| 5,422,792 | A | 6/1995 | Neumann | |
| 6,059,435 | A | 5/2000 | Hamm et al. | |
| 6,186,650 | B1 | 2/2001 | Hulse et al. | |
| 6,186,651 | B1 | 2/2001 | Sayers et al. | |
| 6,220,735 | B1 * | 4/2001 | Matubara | 362/523 |
| 6,341,884 | B1 | 1/2002 | Leleve et al. | |
| 6,354,722 | B1 | 3/2002 | Montenegro et al. | |
| 6,425,683 | B1 | 7/2002 | Kusagaya et al. | |
| 6,742,918 | B2 | 6/2004 | Collins | |
| 6,796,696 | B2 | 9/2004 | Taniuchi | |
| 6,799,874 | B2 | 10/2004 | Nakata | |
| 6,910,790 | B2 | 6/2005 | De Lamberterie et al. | |
| 6,976,772 | B2 | 12/2005 | Albou et al. | |
| 7,173,375 | B2 * | 2/2007 | Takeda et al. | 315/77 |
| 7,182,491 | B2 * | 2/2007 | Cajanek et al. | 362/429 |
| 7,244,055 | B2 * | 7/2007 | Kanzler et al. | 362/514 |
| 2001/0006467 | A1 | 7/2001 | Brun | |
| 2001/0038535 | A1 | 11/2001 | Furuya et al. | |

(Continued)

FOREIGN PATENT DOCUMENTS

| | | | |
|---|---|---|---|
| DE | 100 40 573 | A1 | 3/2002 |

(Continued)

OTHER PUBLICATIONS

German Office Action dated Aug. 18, 2009.

*Primary Examiner*—Anabel M Ton
(74) *Attorney, Agent, or Firm*—Brinks Hofer Gilson & Lione

(57) ABSTRACT

A headlamp assembly for a motor vehicle, including a housing coupling the headlamp assembly to a frame of the motor vehicle, a light source positioned within the housing for emitting light rays, and a reflector positioned within the housing and configured to direct the light rays into a beam. The reflector is movable with respect to the housing and the light source so as to adjust the beam direction.

18 Claims, 4 Drawing Sheets

U.S. PATENT DOCUMENTS

| | | | |
|---|---|---|---|
| 2002/0089853 | A1 | 7/2002 | Taniuchi et al. |
| 2002/0093827 | A1 | 7/2002 | Ishida |
| 2003/0133309 | A1 | 7/2003 | Seif et al. |
| 2003/0189822 | A1 | 10/2003 | De Lamberterie et al. |
| 2004/0136200 | A1 | 7/2004 | Bos et al. |
| 2004/0228139 | A1 | 11/2004 | Taniuchi |
| 2005/0162861 | A1 | 7/2005 | Yamamura et al. |
| 2005/0180154 | A1 | 8/2005 | Albou et al. |

FOREIGN PATENT DOCUMENTS

| | | | |
|---|---|---|---|
| DE | 102 21 684 | A1 | 12/2003 |
| DE | 10 2005 057 524 | A1 | 7/2006 |
| EP | 1 106 906 | A2 | 6/2001 |
| EP | 0 889 281 | B1 | 5/2004 |

* cited by examiner

HEADLAMP ASSEMBLY HAVING AN ADJUSTABLE LIGHT BEAM DIRECTION

BACKGROUND

1. Field of the Invention

The invention relates generally to a headlamp assembly for a motor vehicle. More specifically, the invention relates to a headlamp assembly having a movable reflector for adjusting the direction of a light beam emitted from the headlamp assembly.

2. Related Technology

Headlamp assemblies typically have a light source for emitting light rays, a reflector for directing the light rays in a forward direction as a light beam, and a housing for supporting the above components. In some constructions, a heat sink is connected to the light source for conducting heat away from the headlamp assembly. The reflector is positioned with respect to the light source that the light beam exits the headlamp assembly along a desired beam direction. More specifically, the desired beam direction is typically vertically aligned so that the light beam intersects the road at a point located a predetermined distance from the front of the motor vehicle is typically horizontally aligned so that the light beam shines generally parallel with the orientation of the motor vehicle or slightly laterally therefrom.

In order to initially achieve the desired beam direction, each headlamp assembly may require adjustment during installation into the motor vehicle. Furthermore, due to relatively continuous vibrations and/or other forces acting on the vehicle during operation, the headlamp assemblies may require periodic adjustment in order to maintain the desired beam direction.

Therefore, headlamp assemblies often include an adjustment mechanism for orienting the beam direction as desired. One such adjustment mechanism includes a plurality of adjustable-length connectors coupling the headlamp assembly housing to the vehicle frame. However, this design requires gaps between the headlamp assembly and the frame on several sides of the assembly so that the headlamp assembly is able to travel along the adjustment paths, thereby increasing the packaging space required for each headlamp assembly. Additionally, due to the relative size of each headlamp assembly, multiple adjustable-length connectors are required to effectively adjust the position of the headlamp assembly, thereby increasing the complexity and the part cost of the system and the likelihood that the connectors will become accidentally disconnected or severed.

Another adjustment mechanism includes a housing that is fixedly connected to the motor vehicle frame and a heatsink and/or light source movably coupled with the housing. This design, however, may cause premature wear on electrical connectors for the light source and/or cause the light source to become accidentally disconnected. Additionally, this design may require the electrical connectors to be longer than desired to permit the relative movement of the light source. Furthermore, the heat sink is typically a relatively large, bulky component and may be difficult and/or complicated to move with respect to the housing. This issue is especially troublesome in headlamp assemblies utilizing light emitting diodes (LEDs) because LEDs typically require more heat removal than other light sources, such as incandescent or fluorescent bulbs. Therefore, headlamp assemblies utilizing LEDs typically require relatively large heatsinks.

Headlamp assemblies are often able to alternate between a low beam mode and a high beam mode by moving one or more components of the headlamp assembly to alter the vertical orientation and/or intensity of the light beam. Switching between the two modes is typically accomplished via an actuation assembly that automatically moves one or more headlamp assembly components between first and second positions when the vehicle occupant toggles a switch within the vehicle interior compartment. However, these actuation assemblies are typically only able to move the components between a first position and a second position that result in drastically different beam angles and/or intensities. Therefore, this type of adjustment assembly is not conducive to making incremental adjustments of the beam angle.

Additionally, high/low beam mode actuation assemblies also typically include a plurality of components for moving the relevant components of the headlamp assembly in a relatively quick manner with a relatively low input force from the vehicle occupant. For example, the actuation assembly may include a plurality of gear ratios and/or a plurality of movable components interacting with each other to move the components of the headlamp assembly. These components add to the complexity and the part cost of the headlamp assembly. Furthermore, it may be undesirable for the headlamp assembly to be incrementally adjustable by a relatively low input force during beam orientation because such a configuration may cause inadvertent adjustment of the beam angle.

It is therefore desirous to provide a headlamp assembly that permits adjustment of the beam direction, while minimizing the size and complexity of the adjustment components, minimizing the number and size of the components to be moved during adjustment, and preventing inadvertent beam angle adjustment.

SUMMARY

In overcoming the limitations and drawbacks of the prior art, the present invention provides a headlamp assembly for a motor vehicle, including a housing coupling the headlamp assembly to a frame of the motor vehicle, a light source positioned within the housing for emitting light rays, and a reflector positioned within the housing and configured to direct the light rays into a beam. The reflector is movable with respect to the housing and the light source so as to adjust the beam direction.

In one aspect of the present invention, the headlamp assembly includes a first adjustment component adjustably supporting the reflector such that the reflector is adjustable with respect to the housing and the light source from outside of the housing. The headlamp assembly also preferably includes a motor assembly positioned within the housing. The motor assembly including a motor adjustment portion coupled with the reflector such that movement of the motor adjustment portion adjusts the reflector along a first axis. Additionally, the first adjustment component preferably includes a flexible adjustment member extending through the housing and coupled with the motor adjustment portion such that rotation of the flexible adjustment member moves the motor adjustment portion.

In another aspect of the present invention, the headlamp assembly includes a second adjustment component adjustably supporting the reflector such that the reflector is adjustable with respect to the housing from outside of the housing. The second adjustment component includes an adjustment member having a first end portion extending through the housing and a second end portion coupled with the reflector. The second end portion of the adjustment member is connected to a heatsink that is movably connected to the housing such that rotation of the adjustment member adjusts the position of the heatsink and the reflector.

In another aspect, the second adjustment component includes a rotating means for facilitating rotation of the adjustment member. The adjustment member also preferably includes a locking means for selectively preventing rotation of the adjustment member.

The first adjustment component is preferably configured to adjust the reflector along a first axis and the second adjustment component is preferably configured to adjust the reflector along a second axis.

Further objects, features and advantages of this invention will become readily apparent to persons skilled in the art after a review of the following description, with reference to the drawings and claims that are appended to and form a part of this specification.

DETAILED DESCRIPTION

Figure 1:
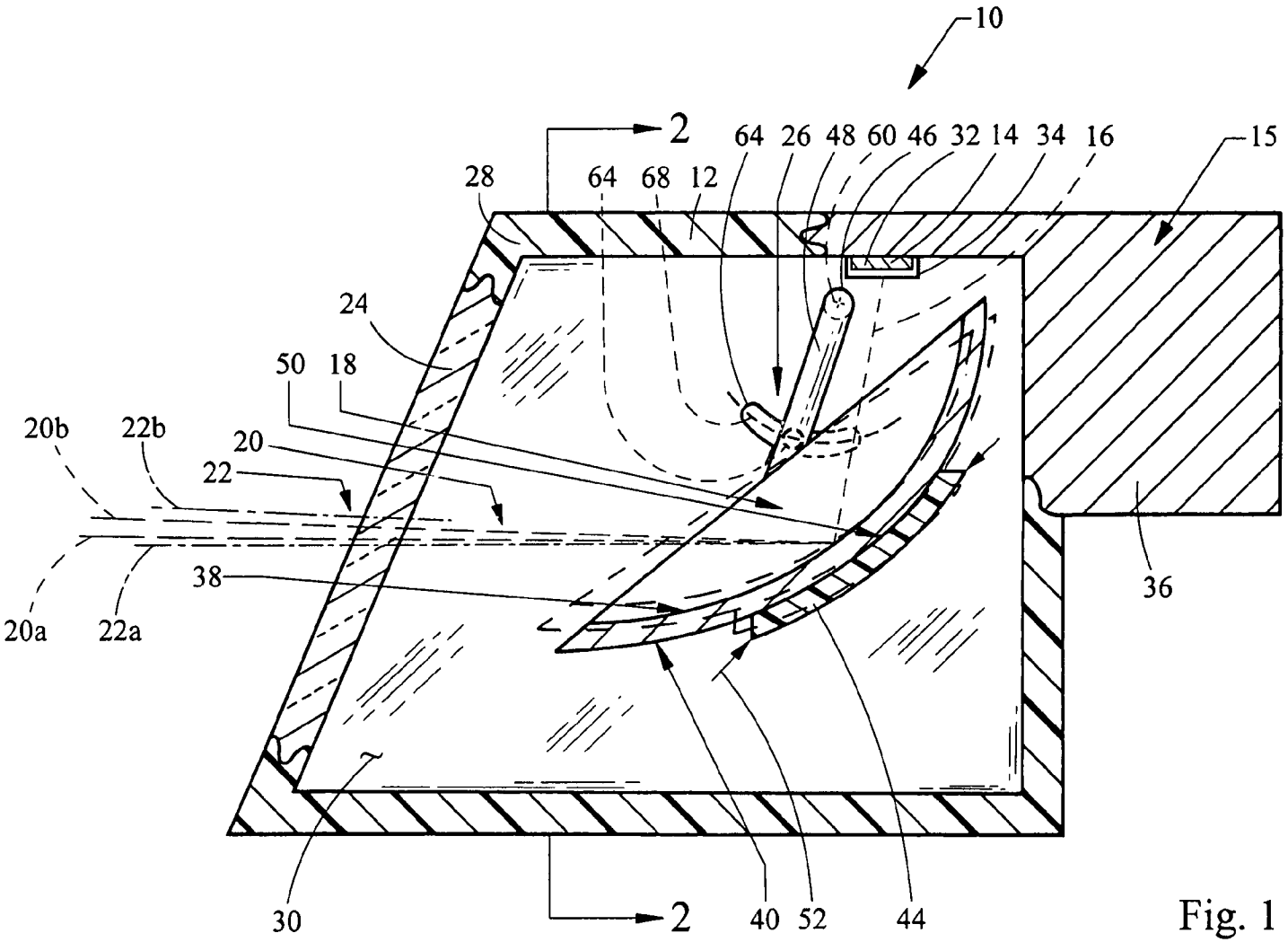
FIG. 1 is a cross-sectional view of a headlamp assembly for a motor vehicle embodying the principles of the present invention and having a reflector movable with respect to the housing.

Referring now to the drawings, FIG. 1 shows a headlamp assembly 10 for use in a motor vehicle. The headlamp assembly 10 generally includes a housing 12 coupling the headlamp assembly 10 to the motor vehicle frame (not shown), a light source such as a light emitting diode ("LED") 14 for emitting light rays 16, a heatsink 15 connected to the housing 12 and supporting the LED 14 for conducting heat away from the headlamp assembly 10, a reflector 18 for directing the light rays 16 (one being shown for clarity) into a light beam 20 (represented by a single dashed line for clarity) extending along a beam direction 22, a lens 24 positioned at a front portion of the housing 12 so as to permit the light beam 20 to exit the headlamp assembly 10 therethrough, and an adjustment 26 for supporting the reflector 18 and adjusting the position thereof so as to adjust the beam direction 22.

The housing 12 includes a plurality of walls 28 cooperating with the lens 24 and the heatsink 15 to define a cavity 30 for the LED 14 and the reflector 18. The cavity 30 is preferably generally sealed to prevent dust and other particulates from contaminating any of the components within the housing 12 or obstructing the light beam 20. The housing 12 is preferably made of a plastic material, such as thermoformed plastic, and includes a plurality of connectors (not shown) for securing the headlamp assembly 10 to the vehicle frame.

The LED 14 preferably includes a chip 32 for emitting light, a translucent protective coating 34 surrounding the chip 32 for protection thereof, and electrical wiring (not shown) supplying electricity thereto. As is known in the art, to illuminate the LED 14 an electrical current is passed to the chip 32 via the electrical wiring and the movement of electrons across a pair of diodes (not shown) causes the LED 14 to emit the light rays 16. Alternatively, any other appropriate light source may be used with the headlamp module 10, including but not limited to incandescent light bulbs, fluorescent light bulbs, or a high intensity discharge lamp.

As mentioned above, heat generated by the LED 14 is conducted away from the headlamp assembly 10 by the heatsink 15. The heatsink 15 preferably includes a plurality of metal fins 36 extending away from the housing 12 to maximize heat exchange between the fins 36 and the ambient air surrounding the heatsink 15. Therefore, the heatsink 15 is preferably positioned in a portion of the vehicle having a relatively high airflow.

The heatsink 15 may be integrally connected with the housing 12 to act as a portion of a wall defining the cavity 30, thereby maximizing the heat to which the heatsink 15 is exposed from within the cavity. As mentioned above, the operation of LEDs produces significantly more heat than other types of light sources. Therefore, the integral connection between the heatsink 15 and the housing 12 is especially beneficial in designs utilizing an LED, such as the embodiment shown in the figures. The heatsink is preferably integrally connected to the housing 12 during formation of the housing 12. Alternatively, the heatsink 15 may be integrally assembled with the housing 12, after the respective components are separately formed, via appropriate fasteners or a press-fit connection.

The reflector 18 includes a front surface 38 that is made of generally reflective material or covered with a generally reflective coating so as to reflect the light rays 16 toward the lens 24. The front surface 38 of the reflector 18 has an appropriate shape and size for generating the light beam 20 with an appropriate intensity and beam pattern. More specifically, the front surface 38 preferably includes a generally parabolic-shaped cross-section for vertically focusing the light rays 16 (best shown in FIG. 1) and a pair of generally sloping side portions 42 for horizontally focusing the light rays 16 (best shown in FIG. 2).

The bracket 26 movably supports the reflector 18 in a desired configuration with respect to the housing 12, the LED 14, and the heatsink 15 to control the orientation of the beam direction 22. Therefore, the beam direction 22 is adjusted via the position of the reflector 18, while the housing 12, the LED 14, and the heatsink 15 remain stationary. More specifically, as shown in FIG. 1, the reflector 18 and the bracket 26 are shown in both a first position (indicated by solid lines) to direct the light rays 16 into a first light beam 20*a* extending along a first beam direction 22*a* and a second position (indicated by phantom lines) to direct the light rays 16 into a second light beam 20*b* extending along a second beam direction 22*b*.

The bracket 26 includes a support portion 44 connected to the rear surface 40 of the reflector 18, an adjustment portion 46 movably coupled to an opening in an outer wall of the headlamp assembly 10, and a connector 48 extending therebetween. The bracket 26 is preferably a single, unitary component made of a material with sufficient strength to prevent the bracket 26 from deflecting or deforming during adjustment.

The support portion 44 includes a support surface 50 generally conforming to the shape of the reflector rear surface 40 so as to provide a secure engagement between the bracket 26 and the reflector 18. For example, the support surface 50 in the figures includes a generally arcuate cross-section corresponding to the arcuate shape of the reflector 18. Additionally, the support portion 44 preferably has a relatively large width 52 (FIG. 1) and a relatively large length 54 (FIG. 2) so as to encompass a substantial portion of the reflector 18 and provide robust support therefore. The reflector 18 may be secured to the support portion 44 via any appropriate means, such as adhesive or fasteners.

Figure 2:
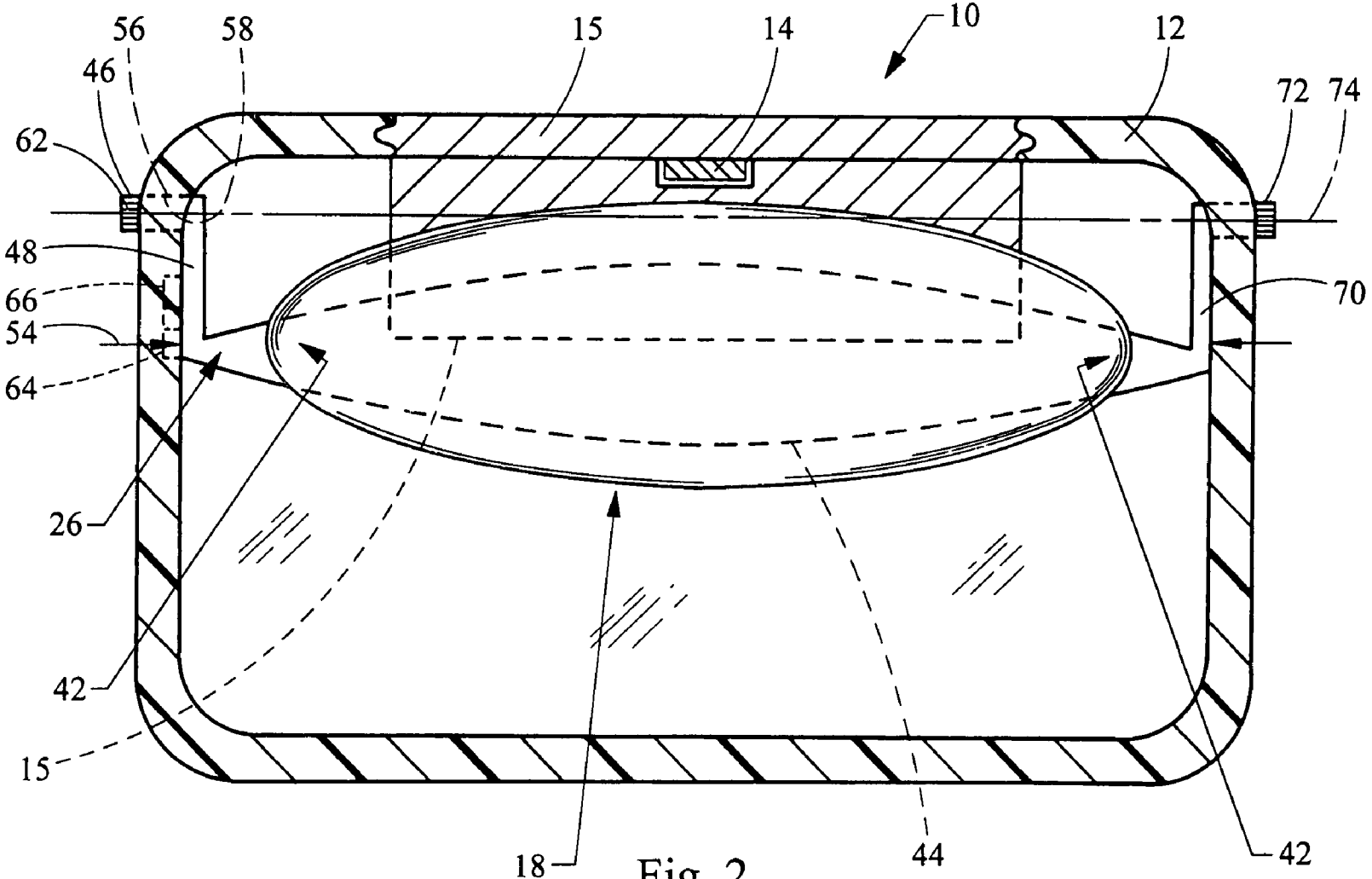
FIG. 2 is a cross-sectional view taken along line 2-2 in FIG. 1.

As best shown in FIG. 2, the adjustment portion 46 includes a rod-shaped member or shaft 56 extending through an opening 58 in an outer wall of the headlamp assembly 10. In the design shown in the figures, the opening 58 extends through a wall of the housing 12, but it could alternatively be defined by another portion of the headlamp assembly such as the heatsink 15. The rod-shaped member 56 and the opening 58 each have generally circular cross-sections so that the adjustment portion 46 is able to rotate within the opening 58 to adjust the position of the bracket 26 and the reflector 18.

Additionally, the adjustment portion 46 includes an engagement portion for facilitating the movement of the bracket 26 with respect to the housing 12. For example, as shown in FIG. 1, an end surface of the adjustment portion 46 includes an indentation 60 configured to receive a screwdriver head or another type of turning device, so that the adjustment portion 46 can be manually rotated by the person adjusting the beam direction 22. Additionally, as shown in FIG. 2, the other radial surface of the adjustment portion 46 includes knurls 62 to aid in gripping the adjustment portion 46.

Although the above features facilitate rotation of the bracket 26, the adjustment portion 46 is preferably snug, friction fit within the opening to minimize unintended or inadvertent movement of the bracket 26. Therefore, even after utilizing the above-discussed engagement features, rotation of the bracket 26 preferably requires a relatively significant torque applied to the adjustment portion 46.

Additionally, to prevent accidental adjustment of the reflector 18, the bracket 26 may further include a locking means (not shown) to selectively lock the bracket to the housing. For example, in one design the guiding slot extends completely through the housing wall so that the guiding tab is able to extend through the housing wall. The guiding tab is selectively locked to the outer wall of the housing via an appropriate locking means such as a wing nut or another fastener.

As mentioned above, the support portion 44 and the adjustment portion 46 of the bracket 26 are connected to each other by a connector 48. The connector 48 is preferably generally perpendicular to the adjustment portion 46 so as to extend along the inner wall of the housing 12. Moreover, the connector 48 preferably includes a guiding boss 64 extending into a guiding slot 66 formed in the housing inner wall to guide the bracket 26 along an adjustment path 68. The guiding components 64, 66 prevent the bracket 26 from deflecting and producing an undesired reflector 18 position, thereby improving the accuracy of the beam orientation.

Additionally, to further improve the stability of the bracket 26, the support portion 44 preferably extends substantially completely across the cavity 30 and the bracket 26 includes a second connector arm 70 and a second adjustment portion 72 opposite the first adjustment portion 46. Therefore, the entire bracket 26 is able to rotate about a rotational axis 74 extending between the respective adjustment portions 47, 72 of the bracket 26. The second adjustment portion 72 preferably includes a plurality of indentations or a plurality of radial ribs as described above with respect to the first adjustment portion 46 so that the beam direction 22 can be adjusted from either side of the housing 12 or from both sides at the same time to further prevent deflection of the bracket.

In an alternative design, the adjustment portion is movable with respect to the housing 12 via a configuration other than rotation, such as a slidable connection between the bracket and the housing.

Figure 3:
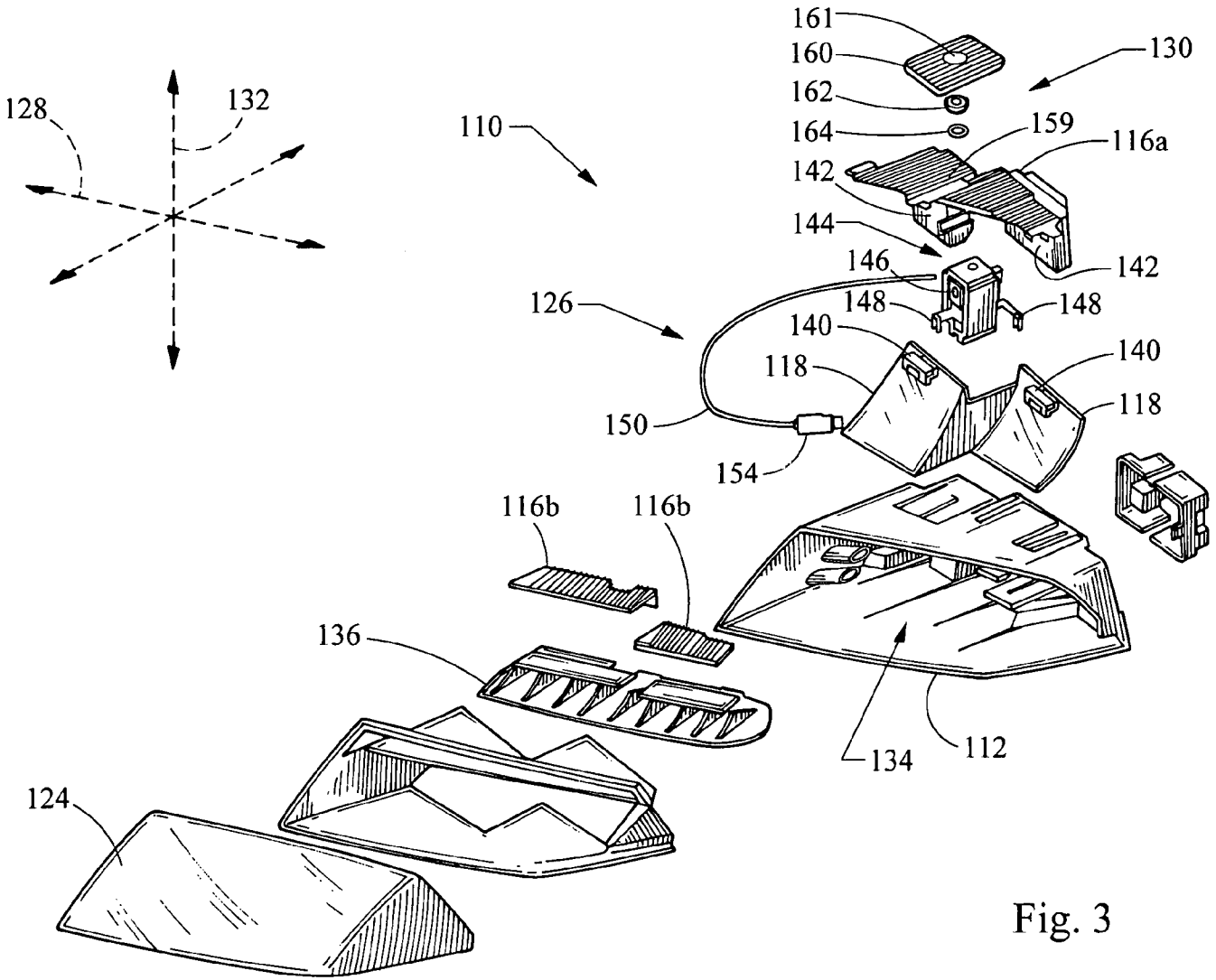
FIG. 3 is an exploded, isometric view of a second embodiment of a headlamp assembly for a motor vehicle embodying the principles of the present invention and having a reflector movable with respect to the housing.
Figure 4:
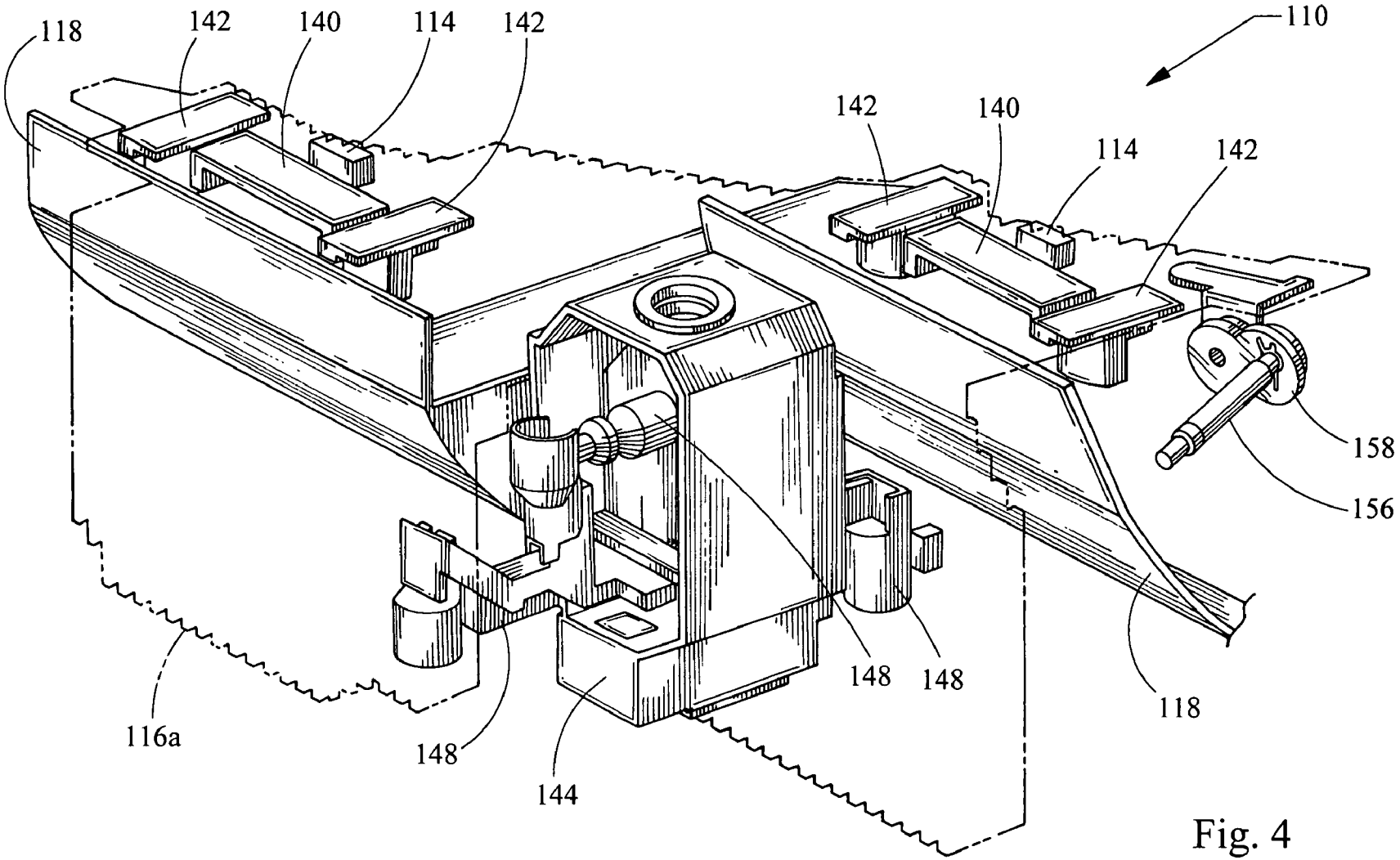
FIG. 4 is an isometric view of a heatsink, a reflector, and a plurality of adjustment components of the headlamp assembly shown in FIG. 3, where the heatsink is shown in phantom lines.

Referring now to FIGS. 3 and 4, a second embodiment of a headlamp assembly 110 is shown. The headlamp assembly 110 generally includes a housing 112 coupling the headlamp assembly 110 to the motor vehicle frame (not shown), a light source such as a light emitting diode ("LED") 114 for emitting light rays, upper and lower heatsink components 116*a*, 116*b* connected to the housing 112 and supporting the LED 114 for conducting heat away from the headlamp assembly 110, a pair of reflectors 118 for directing the light rays into a light beam, a lens 124 positioned at a front portion of the housing 112 so as to permit the light beam to exit the headlamp assembly 110 therethrough, a first adjustment component 126 for adjusting the position of the reflectors 118 along a first axis 128 and a second adjustment component 130 for adjusting the position of the reflectors 118 along a second axis 132.

The housing 112 in the figures is a plastic molded component that is connected to the housing by any suitable means, such as mechanical fasteners (not shown). The housing 112 defines a cavity 134 for receiving the heatsink components 116*a*, 116*b* and a turn indicator reflector 136. The lower heatsink components 116*b* and the turn indicator reflector 136 are each connected to a housing wall defining the cavity 134 by a suitable means, such as mechanical fasteners, adhesives, or thermal bonding. The lower heatsink components 116*b* operate to remove heat from the turn signal indicator LEDs (not shown). The cavity 134 is of a shape and size for housing the reflectors 118 and the first adjustment component 126, as will be discussed in further detail below.

The upper heatsink component 116*a* is connected to the housing 112 by the second adjustment component 130, such that the upper heatsink component 116*a* is pivotable with respect to the housing 112 along the second axis 132, as will be discussed in further detail below. Additionally, the LEDs 114 are connected to the upper heatsink component 130 such that light rays shine down toward the reflector 118 and are directed forwards into a light beam.

The reflectors 118 are pivotally mounted with respect to the upper heatsink component 116*a* via tabs 140 fixedly connected to the reflectors 118 and receivers 142 fixedly connected to the upper heatsink component 116*a*. Specifically, the tabs 140 are pivotally received within the receivers 142 such that the reflectors are pivotable with respect to the upper heatsink component 116*a* along the first axis 128.

The headlamp assembly 110 also includes a motor assembly 144 mounted within the housing 112 and having a rotor 146 and a plurality of adjustment arms 148 connected to the rotor 146 and configured to engage the reflector 118 to control the position thereof. Specifically, rotation of the rotor 146 moves the adjustment arms 148, thereby causing pivoting movement of the reflector about the first axis 128 with respect to the upper heatsink component 116*a*, the housing 112, and the LEDs 114 and controlling the vertical alignment of the light beam. The motor assembly 144 is preferably a stepper motor.

The position of the rotor 146 within the motor assembly 144 is generally adjustable via two means: an electronic adjustment control and a mechanical adjustment control. The electronic adjustment control includes an electronic receiver (not shown) positioned within the motor assembly 144 such that the rotor 146 is adjustable via electronic signals received by the electronic receiver. For example, the vehicle may include controls for automatically maintaining the vertical position of the headlamp assembly light beam with respect to the road. Specifically, the controls are configured to detect the vertical position or to detect changes in the vertical position of the vehicle with respect to the road, via position sensors or accelerometers. The controls are also configured to transmit signals to the receiver based on the position of the vehicle. Therefore, the position of the rotor 146, and thus the position of the reflectors 118 and the vertical alignment of the headlamp light beam, is able to be automatically adjusted during operation of the vehicle.

The mechanical adjustment control includes the first adjustment component 126, which is used to mechanically align the rotor 146 in an initial position. For example, the fist adjustment component 126 shown in the figures is a flexible adjustment rod 150 having a first end 152 connected to the rotor 146 of the motor assembly 144 and a second end 154 positioned adjacent to a front portion of the housing 112 such as to be accessible from the exterior of the headlamp assembly 110. The first end 152 of the flexible adjustment rod 150 extends into an opening in the rotor 146 such that rotation of the flexible adjustment rod 150 causes rotation of the rotor 146. Additionally, the second end 154 of the flexible adjustment rod 150 is connected to an adjustment screw 156 (FIG. 4) extending through an opening in the housing 112 and connected to the upper heatsink component 116*a* by a bracket 158. More specifically, the second end 154 of the flexible adjustment rod 150 fits tightly around the portion of the adjustment screw 156 that is located within the housing 112 such that the respective components 150, 156 rotate in unison. The outer end of the adjustment screw 156, which is accessible from the exterior of the headlamp assembly 110, includes screw-head indentations or a gripping means to facilitate rotation of the adjustment screw 156. Therefore, via the adjustment screw 156, the position of the rotor 146, and thus the position of the reflectors 118 and the vertical alignment of the headlamp light beam, is able to be manually adjusted. This adjustment typically occurs during assembly or maintenance of the headlamp assembly 110.

As mentioned above, the headlamp assembly 110 also includes a second adjustment component 130 for adjusting the position of the reflectors 118 with respect to the housing 112 along the second axis 132. Specifically, the reflectors are adjustable along the second axis 132 to adjust the horizontal alignment of the headlamp light beam.

The headlamp assembly 110 includes a support plate 160 positioned on the outer surface of the housing 112, opposite the upper heatsink component 116*a*. The second adjustment component 130 includes an adjustment screw 159 integrally formed with the upper heatsink component 116*a* and extending through the housing 112 and through an opening 161 in the support plate 160 such that the upper heatsink component 116*a* is rotatably adjustable about the second axis 132 with respect to the housing 112 via the adjustment screw 159. Additionally, a locking nut 162 and a washer 164 are provided to prevent unwanted movement between the adjustment screw 159 and the housing 112. Therefore, via the adjustment screw 159, the position of the upper heatsink component 116*a*, and thus the position of the reflectors 118 and the horizontal alignment of the headlamp light beam, is able to be manually adjusted. This adjustment typically occurs during assembly or maintenance of the headlamp assembly 110.

It is therefore intended that the foregoing detailed description be regarded as illustrative rather than limiting, and that it be understood that it is the following claims, including all equivalents, that are intended to define the spirit and scope of this invention.

What is claimed is:

1. A headlamp assembly for a motor vehicle, comprising:

a housing coupling the headlamp assembly to a frame of the motor vehicle;

a light source positioned within the housing and configured to emit light rays;

a reflector positioned within the housing and configured to direct the light rays into a beam extending in a beam direction, wherein the reflector is movable with respect to both the housing and the light source so as to adjust the beam direction; and a first adjustment component adjustably supporting the reflector within the housing and extending to a position outside of the housing, the reflector being adjustably mounted for movement with respect to the housing and with respect to the light source by manipulation of the first adjustment component from outside of the housing.

2. A headlamp assembly as in claim 1, further comprising a motor assembly positioned within the housing, the motor assembly including a motor adjustment portion coupled with the reflector such that movement of the motor adjustment portion adjusts the reflector along a first axis.

3. A headlamp assembly as in claim 2, wherein the first adjustment component includes a flexible adjustment member extending through the housing and coupled with the motor adjustment portion such that rotation of the flexible adjustment member moves the motor adjustment portion.

4. A headlamp assembly as in claim 2, the motor assembly further including a connector arm coupling the motor adjustment portion with the reflector such that movement of the motor adjustment portion adjusts the reflector along the first axis.

5. A headlamp assembly for a motor vehicle, comprising:

a housing coupling the headlamp assembly to a frame of the motor vehicle;

a light source positioned within the housing and configured to emit light rays;

a reflector positioned within the housing and configured to direct the light rays into a beam extending in a beam direction, wherein the reflector is movable with respect to the housing and the light source so as to adjust the beam direction;

a first adjustment component adjustably supporting the reflector within the housing and extending to a position outside of the housing, the reflector being adjustably supported for movement with respect to the housing and for movement with respect to the light source by manipulation of the first adjustment component from outside of the housing; and a second adjustment component adjustably supporting the reflector within the housing and extending to a position outside of the housing, the reflector being adjustably supported for movement with respect to the housing by manipulation of the second adjustment component from outside of the housing.

6. A headlamp assembly as in claim 5, the first adjustment component configured to adjust the reflector along a first axis and the second adjustment component configured to adjust the reflector along a second axis.

7. A headlamp assembly as in claim 6, wherein the second adjustment component includes an adjustment member having a first end portion extending through the housing and a second end portion coupled with the reflector.

8. A headlamp assembly as in claim 7, further comprising a heatsink connected to the reflector, the heatsink movably connected to the housing such that the heatsink and the reflector are movable with respect to the housing.

9. A headlamp assembly as in claim 8, the second end portion of the adjustment member connected to the heatsink such that rotation of the adjustment member adjusts a position of the heatsink and the reflector with respect to the housing.

10. A headlamp assembly as in claim 9, the first end portion of the adjustment member including a rotating means for facilitating rotation of the adjustment member.

11. A headlamp assembly as in claim 10, the adjustment member further including a locking means for selectively preventing rotation of the adjustment member.

12. A headlamp assembly as in claim 1, further comprising a heatsink positioned within the housing and configured to support the reflector within the housing.

13. A headlamp assembly as in claim 12, further comprising a hinge mechanism coupling the reflector to the heatsink such that the reflector is adjustable along an axis extending through the hinge mechanism.

14. A headlamp assembly as in claim 1, wherein the light source is a light emitting diode.

15. A headlamp assembly for a motor vehicle, comprising:

a housing coupling the headlamp assembly to a frame of the motor vehicle;

a light source positioned within the housing and configured to emit light rays;

a heatsink positioned within the housing and movably coupled to the housing; and a reflector connected to the heatsink and configured to direct the light rays into a beam extending in a beam direction, wherein the heatsink and the reflector are movable with respect to both the housing and the light source so as to adjust the beam direction, and a first adjustment component adjustably supporting the reflector such that the reflector is adjustable with respect to the housing and the light source from outside of the housing.

16. A headlamp assembly as in claim 15, further comprising a hinge mechanism coupling the reflector to the heatsink such that the reflector is adjustable along an axis extending through the hinge mechanism.

17. A headlamp assembly as in claim 15, further comprising a second adjustment component adjustably supporting the reflector such that the reflector is adjustable with respect to the housing from outside of the housing.

18. A headlamp assembly as in claim 17, the first adjustment component configured to adjust the reflector along a first axis and the second adjustment component configured to adjust the reflector along a second axis.

* * * * *